US006122928A

United States Patent [19]

Strobel et al.

[11] Patent Number: 6,122,928

[45] Date of Patent: Sep. 26, 2000

[54] ICE CHEST AND COLD PLATE APPARATUS

[75] Inventors: John M. Strobel, West Allis; Dennis W. Weigand, Theresa; Gary H. Backhaus, West Bend, all of Wis.

[73] Assignee: Perlick Corporation, Milwaukee, Wis.

[21] Appl. No.: 09/407,922

[22] Filed: Sep. 29, 1999

[51] Int. Cl.[7] ..... B67D 5/62

[52] U.S. Cl. ..... 62/398; 62/389; 62/396; 222/146.6

[58] Field of Search ..... 62/389, 394, 395, 62/396, 398, 458, 459; 222/146.6

[56] References Cited

U.S. PATENT DOCUMENTS

| | | | |
|---|---|---|---|
| Re. 34,834 | 1/1995 | Swanson | 62/398 |
| 2,607,519 | 8/1952 | Sanborn . | |
| 2,673,005 | 3/1954 | Brown . | |
| 2,871,675 | 2/1959 | Cornelius . | |
| 3,331,536 | 7/1967 | Lorenzo . | |
| 4,291,546 | 9/1981 | Rodth . | |
| 4,651,538 | 3/1987 | Bull et al. . | |
| 4,676,405 | 6/1987 | Lents et al. | 222/146.6 X |
| 4,678,104 | 7/1987 | Pritchett . | |
| 4,888,961 | 12/1989 | McMichael . | |
| 4,909,047 | 3/1990 | Koeneman et al. . | |
| 4,958,505 | 9/1990 | Swanson . | |
| 5,226,296 | 7/1993 | Kolvites et al. . | |
| 5,343,716 | 9/1994 | Swanson et al. . | |
| 5,350,085 | 9/1994 | Kidd et al. . | |
| 5,350,086 | 9/1994 | Martin et al. . | |
| 5,484,015 | 1/1996 | Kyees . | |
| 5,987,900 | 11/1999 | Love | 62/396 X |

*Primary Examiner*—William Doerrler
*Assistant Examiner*—Chen-Wen Jiang
*Attorney, Agent, or Firm*—Godfrey & Kahn, SC; William K. Baxter

[57] ABSTRACT

An improved ice chest and cold plate apparatus for use in beverage dispensers. The ice chest and cold plate apparatus includes an ice storage container having an open top, a bottom, and four sidewalls. A cold plate heat exchanger is affixed to the outer surface of the bottom of the ice storage container with a thermally conductive adhesive. The cold plate includes a plurality of cooling circuits comprising tubular coils extending in a serpentine path and die-cast in aluminum to form an aluminum block. The improved ice chest and cold plate apparatus is simpler, less expensive and easier to manufacture than prior art ice chests with cold plates.

31 Claims, 4 Drawing Sheets

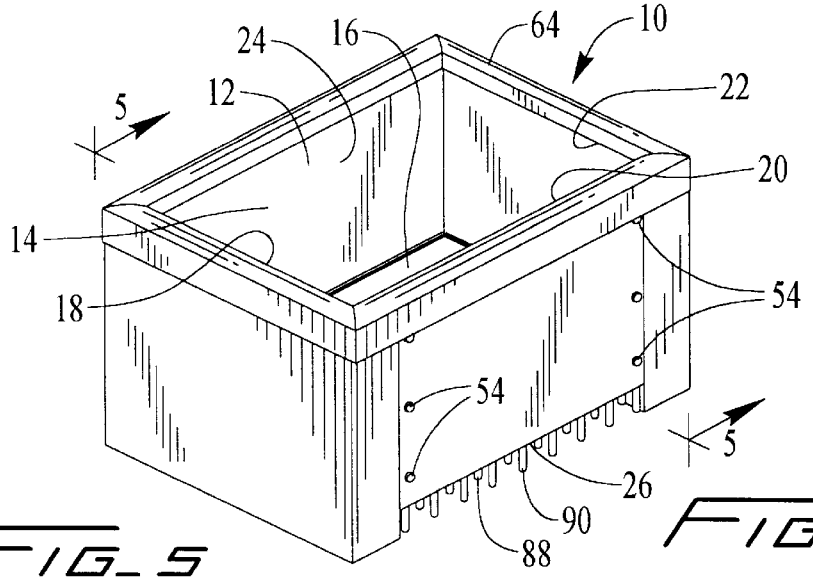
FIG_1
FIG_5
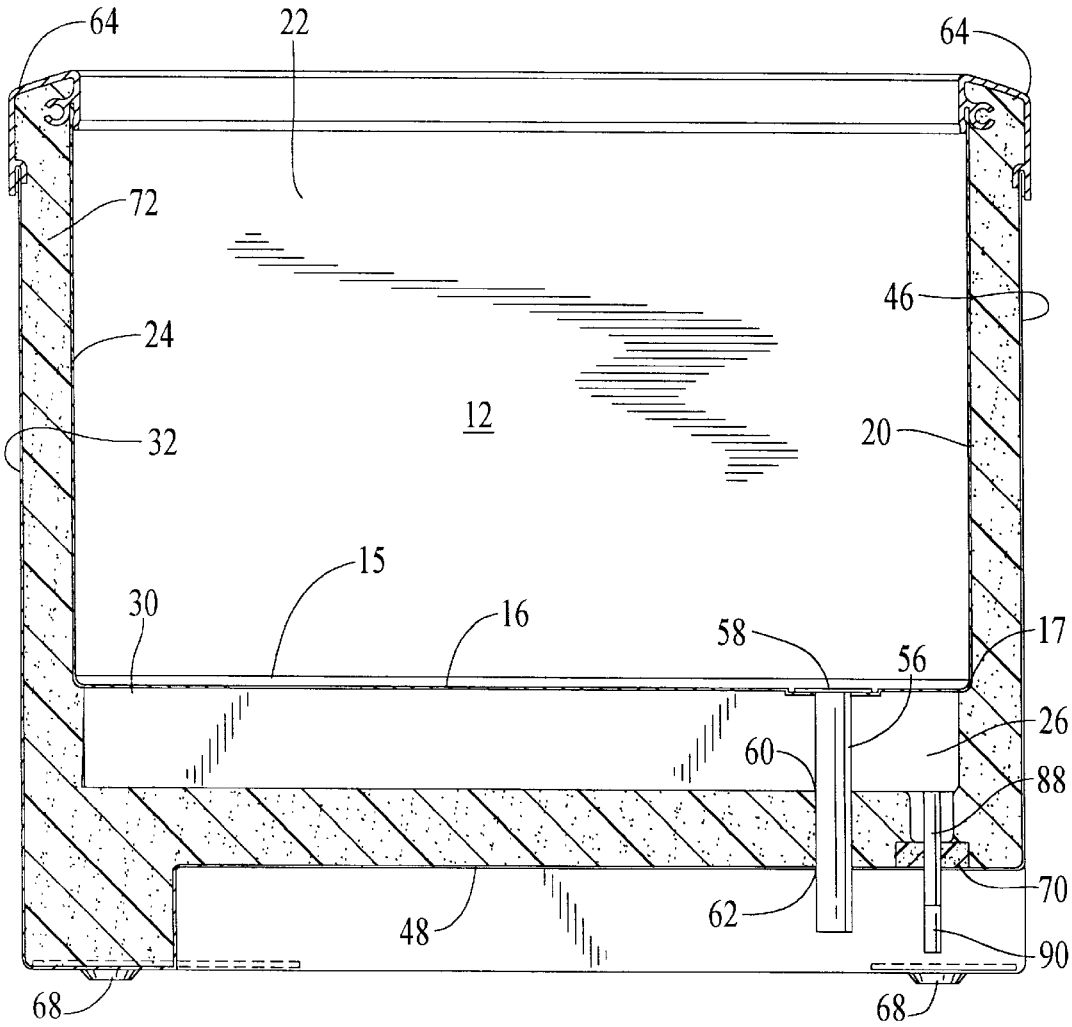

64
56
15
12
20
18
14
24
22
16
17
26
30
10
44
86
70
68
68
68
84
46
42
84
68
34
62
52
84
50
32
48
40
38
36

ICE CHEST AND COLD PLATE APPARATUS

BACKGROUND OF THE INVENTION

The present invention relates to beverage dispensing equipment, and more particularly to an improved ice chest and cold plate apparatus having a cold plate heat exchanger attached to the bottom surface of an ice storage container with a thermally conductive adhesive.

Ice cooled beverage dispensers for cooling soft drinks and other beverages are well known in the art. These beverage dispensers are known and used extensively in restaurants, bars, amusement parks, concession stands, movie theaters, and the like. The ice cooled beverage dispensers typically utilize an ice chest including a cast aluminum cold plate to chill carbonated water and flavoring syrups before mixing and dispensing these liquids in a finished soft drink. Such dispensers consist of a source of carbonated water, a source of flavoring syrup, a cold plate to cool the carbonated water and syrup, and dispensing valves to mix the carbonated water and syrup prior to dispensing the mixed beverage into a glass or cup.

Cold plates are known devices where melting ice is used to cool beverage liquids flowing through tubing in thermal contact with ice. The cold plate normally includes stainless steel tubes or coils embedded within a heat conducting aluminum casting. The cold plate or aluminum block is typically located at the bottom of an ice storage container. The coils are routed to appropriate mixing valves where the beverages are dispensed. The ice storage container thus serves the dual purpose of storing ice to dispense with the beverages and containing ice to cool fluids flowing through the coils.

This type of dispenser is very popular and reliable because it does not require an electromechanical refrigeration system, it is relatively inexpensive, it is portable, it does not require electricity, and it is very efficient. However, there are problems associated with the prior art ice cooled beverage dispensers. The construction of certain prior art ice chests and cold plates can lead to growth of mold and fungus in crevices and other areas of the ice chest which are difficult to clean. Generally the aluminum cold plate is fitted into an opening in the bottom of the stainless steel ice chest, and it is the seams or crevices between the aluminum and stainless where such problems can most commonly arise.

Another problem is the high cost of construction and labor involved with cutting the bottom out of an ice chest and inserting a cold plate therein, or manufacturing an ice chest with a cold plate at the bottom of the ice chest. Most prior art ice chests have an open bottom for receiving a cold plate. With the bottom of the ice chest closed by the cold plate, the ice chest can be repeatedly filled with ice to maintain a low temperature of the cold plate. In this configuration, the aluminum from the cold plate is in direct contact with the ice. This direct contact between the aluminum and the ice is undesirable because the surface of the aluminum is not sufficiently smooth to prevent the buildup of dirt within the inherent crevices of the material.

For example, U.S. Pat. No. 4,678,104 to Pritchett discloses a cooling system for dispensing beverages having an ice tub with an open bottom to receive a cold plate. The cold plate is bolted to the sidewalls of the tub to form the bottom of the tub. U.S. Pat. No. 4,958,505 to Swanson discloses an ice cooled beverage dispenser with a cold plate attached to the open bottom of a tubular ice bin liner. The cold plate is attached to the sidewalls of the ice bin liner with rivet type fasteners or screws.

SUMMARY OF THE INVENTION

The present invention provides an improved ice chest and cold plate apparatus which is simple and inexpensive to manufacture. The cold plate heat exchanger for cooling carbonated liquids in a beverage dispenser is attached to the bottom of an ice storage container with a thermally conductive adhesive. The improved ice chest and cold plate apparatus is designed for use with beverage dispensing equipment.

The present invention permits the construction of a seamless or one-piece ice chest. In prior art devices, cold plates were inserted into an opening within the bottom of the ice chest. Once inserted in the opening, gaps between the cold plate and the ice chest must be sealed to prevent leakage of water through the openings. Seams and gaps provide locations for bacterial and viral growth. These problems are eliminated by affixing the cold plate to the bottom surface of the ice chest, eliminating the need for an opening in the bottom of the ice chest, and achieving sufficient thermal conduction from the ice through the bottom of the ice chest to the cold plate.

In one embodiment, the cold plate includes cooling circuits made up of stainless steel coils wound in serpentine patterns to fit within a rectangular space. The coils of tubing carrying fluids through the cold plate and traversing the rectangular shaped cold plate along a serpentine path. The coils are bound together using strapping and bracing. The coils are die-cast in aluminum to form a cold plate block. The aluminum is cast around the stainless steel coils of the cooling circuits. The block is then attached to the bottom of the ice chest with a thermally conductive adhesive. The adhesive is applied evenly across the entire top surface of the cold plate. Various fluids, such as beverages, are passed through the coils in the cold plate block and cooled due to thermal conduction through the bottom of the ice chest and through the adhesive. A drain opening is provided in the cold plate to allow drainage of water and melting ice from the ice chest.

The present invention also includes the method of affixing the cold plate block to the bottom surface of the ice storage container with an adhesive.

The benefits of the present invention include eliminating the sanitary problems while maintaining good heat transfer. There is a significant cost reduction in manufacturing the ice chest and cold plate apparatus of the present invention with no change in efficiency or performance. Accordingly, the present invention significantly reduces the sanitary problems associated with prior art units because the integrity of the ice chest is maintained. In addition, the ice chest can be used with or without the cold plate, resulting in more universal parts.

Various other features, objects, and advantages of the invention will be made apparent to those skilled in the art from the following drawings and detailed description.

BRIEF DESCRIPTION OF THE DRAWINGS

The drawings illustrate the best mode presently contemplated of carrying out the invention.

In the drawings:

FIG. 1 is an isometric view of an improved ice chest and cold plate apparatus constructed in accordance with the present invention;

FIG. 5 is a cross-sectional view of the improved ice chest and cold plate apparatus taken along line 5—5 of FIG. 1.

DESCRIPTION OF THE PREFERRED EMBODIMENTS

Figure 2:
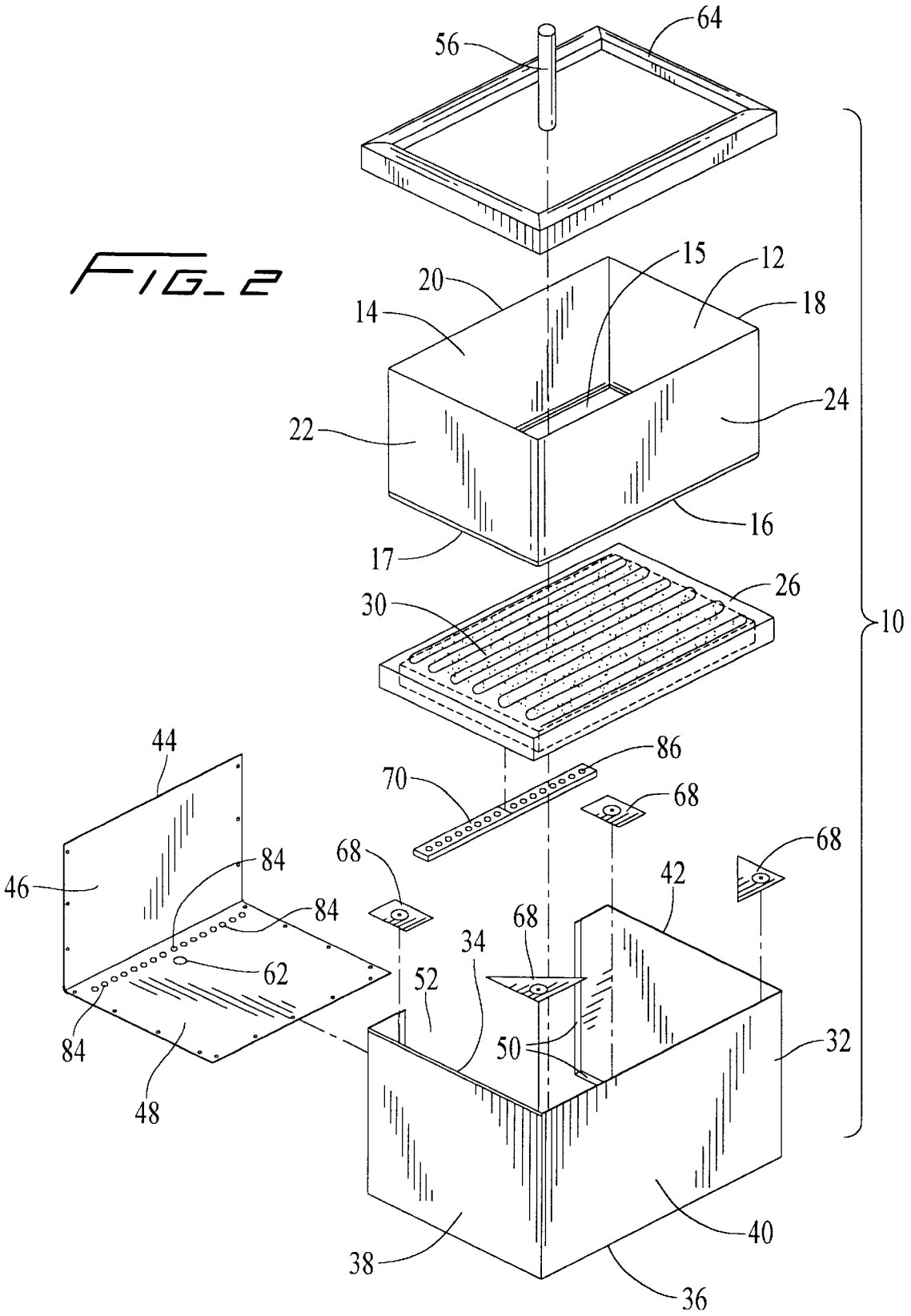
FIG. 2 is an exploded isometric view of the improved ice chest and cold plate apparatus of FIG. 1.

Referring first to FIGS. 1 and 2, an improved ice chest and cold plate apparatus 10 is shown constructed in accordance with the present invention. The ice chest and cold plate apparatus 10 includes an ice storage container 12 having an open top 14, a bottom 16, and four sidewalls 18, 20, 22 and 24. The bottom 16 of the ice storage container 12 having an inner surface 15 and an outer surface 17. The outer surface 17 of the bottom 16 of the ice storage container 12 is substantially smooth and flat. The ice storage container 12 is a single one-piece unit free of grooves, seams, or burrs, preferably made of stainless steel, and designed for containing ice for cooling beverages.

Attached to the outer surface 17 of the bottom 16 of the ice storage container 12 is a cold plate heat exchanger 26. The cold plate heat exchanger 26 includes a plurality of cooling circuits 28, FIG. 3, cast in a heat conducting material, such as aluminum, to form a solid aluminum block. The cooling circuits 28 include coils 82 which traverse through the aluminum casting in a substantially serpentine path. The ice storage container 12 is constructed to contain a quantity of ice for cooling fluids flowing through the coils 82 in the cold plate heat exchanger 26.

The cold plate heat exchanger 26 is preferably affixed to the bottom 16 of the ice storage container 12 with a thermally conducting adhesive 30. The adhesive 30 is preferably a casting resin designed for applications requiring a high degree of thermal conductivity, such as Kit Packers APC 1200.

Enclosing the ice storage container 12 and the cold plate heat exchanger 26 is an outer enclosure 32. The outer enclosure 32 includes an open top 34, an open bottom 36, and three outer sidewalls 38, 40, 42 which wrap around the ice storage container 12 and cold plate 26 in a spaced apart relationship. A panel assembly 44 having a back panel 46 and a bottom panel 48 connected substantially perpendicular to one another is attached to the outer enclosure 32 along flanges 50 in an open sidewall 52 and open bottom 36. The bottom panel 48 includes a plurality of openings 84 extending therethrough in a longitudinal line along one side thereof for receiving inlets 88 and outlets 90 of the cooling circuits 28, and a larger opening 62 for receiving a drain member 56 of the ice storage container 12. The panel assembly 44 is attached to the outer enclosure 32 by any suitable fastening system, preferably fastening devices 54 as shown in FIG. 1.

Figure 4:
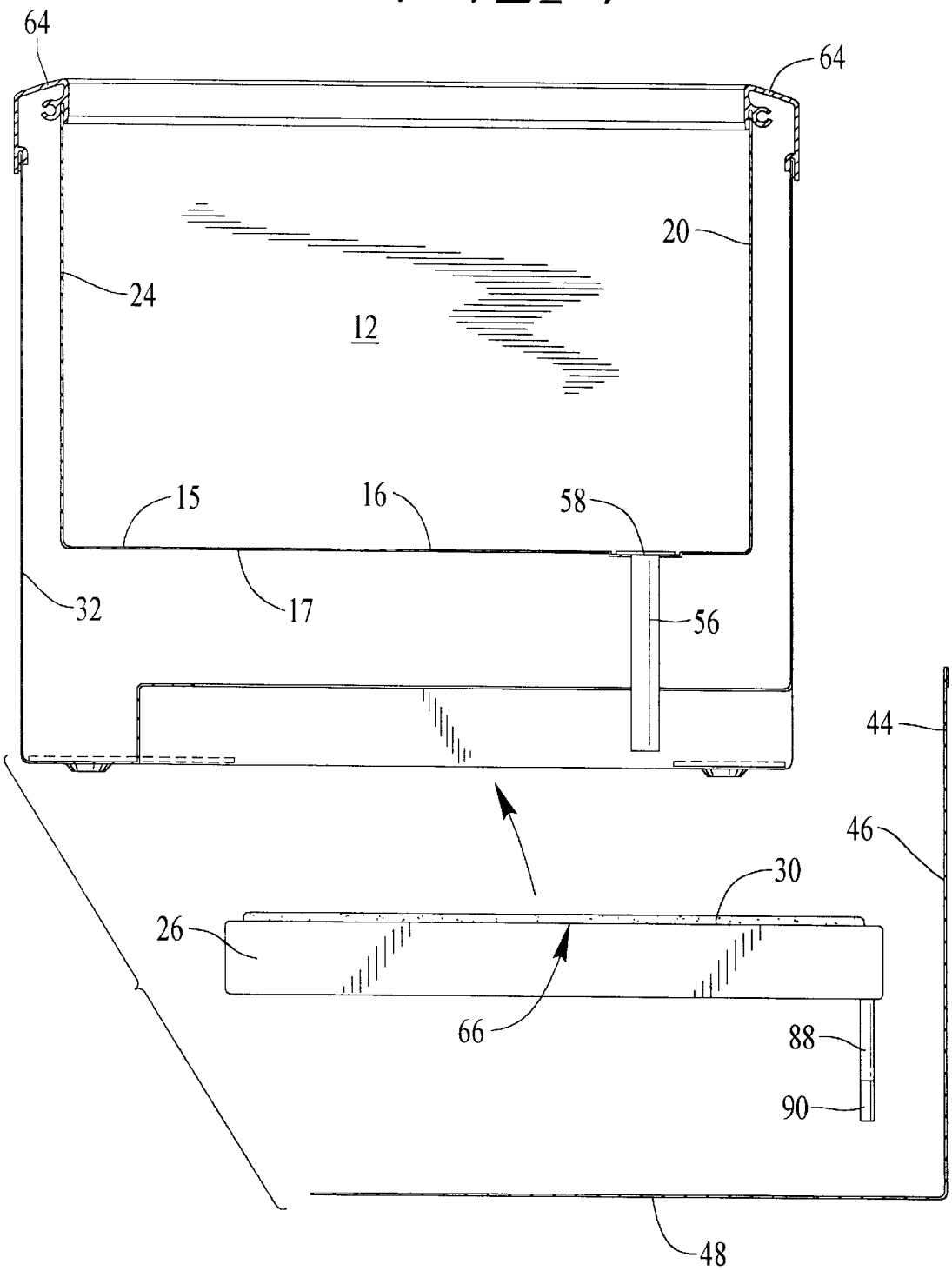
FIG. 4 is an exploded cross-sectional side elevational view of certain parts of the improved ice chest and cold plate prior to attaching the cold plate to the bottom of the ice chest.

The drain member 56 extends through an opening 58, FIG. 4, in the bottom 16 of the ice storage container 12, an opening 60, FIG. 5, in the cold plate heat exchanger 26, and the opening 62 in the bottom panel 48 of the panel assembly 44, to drain ice melt from the ice storage container 12. In the most preferred embodiment openings 58, 60, 62 are substantially aligned. A flange 64 extends around the upper periphery of the sidewalls 18, 20, 22, 24 of the ice storage container 12, the sidewalls 38, 40, 42 of the outer enclosure 32, and the back panel 46. Also included in the improved ice chest and cold plate apparatus 10 is a foam gasket 70 inserted between the cold plate heat exchanger 26 and the bottom panel 48. The gasket 70 includes a plurality of openings extending therethrough to accommodate the inlets 88 and outlets 90 of the cooling circuits 28. Mounting leg plates 68 are attached to the outer enclosure 32 at each corner along the bottom of the enclosure 32.

FIG. 4 is an exploded cross-sectional side view of certain parts of the improved ice chest and cold plate apparatus 10 prior to attaching the cold plate 26 to the outer surface 17 of the bottom 16 of the ice storage container 12. The improved construction includes a cold plate 26 affixed to the outer surface 17 of the bottom 16 of the ice storage container 12 with a thermally conductive adhesive 30. The outer surface 17 of the bottom 16 of the ice storage container 12 is substantially smooth and flat. In addition, the top surface 66 of the cold plate 26 is substantially smooth and flat as well. A thin, continuous layer of adhesive 30 is applied to the substantially smooth, flat, top surface 66 of the cold plate 26. The adhesive 30 is evenly and thinly applied to the entire top surface 66 of the cold plate 26 at a thickness of approximately 0.005 inches. The adhesive 30 is preferably APC 1200, manufactured by Kit Packers, a division of Ellsworth Adhesive Systems. The adhesive applied top surface 66 of the cold plate 26 is brought into contact with and affixed to the outer surface 17 of the bottom 16 of the ice storage container 12 and allowed to cure for an appropriate period of time. Alternatively, the adhesive may be evenly and thinly applied to the entire outer surface 17 of the bottom 16 of the ice storage container 12. The panel assembly 44, including the back panel 46 and the bottom panel 48 is attached to the flange 64 and outer enclosure 32 after affixing the cold plate heat exchanger 26 to the bottom of the ice storage container 12.

FIG. 5 is a cross-sectional view of the improved ice chest with cold plate apparatus 10 taken along line 5—5 of FIG. 1. Foam insulation 72 is inserted in the cavity between the sidewalls 18, 20, 22, 24 of the ice storage container 12 and the back panel 46 and the outer sidewalls 38, 40, 42 of the outer enclosure 32, and between the bottom of the cold plate 26 and the bottom panel 48. The insulation 72 minimizes heat loss through the walls and bottom of the improved ice chest and cold plate apparatus 10.

Figure 3:
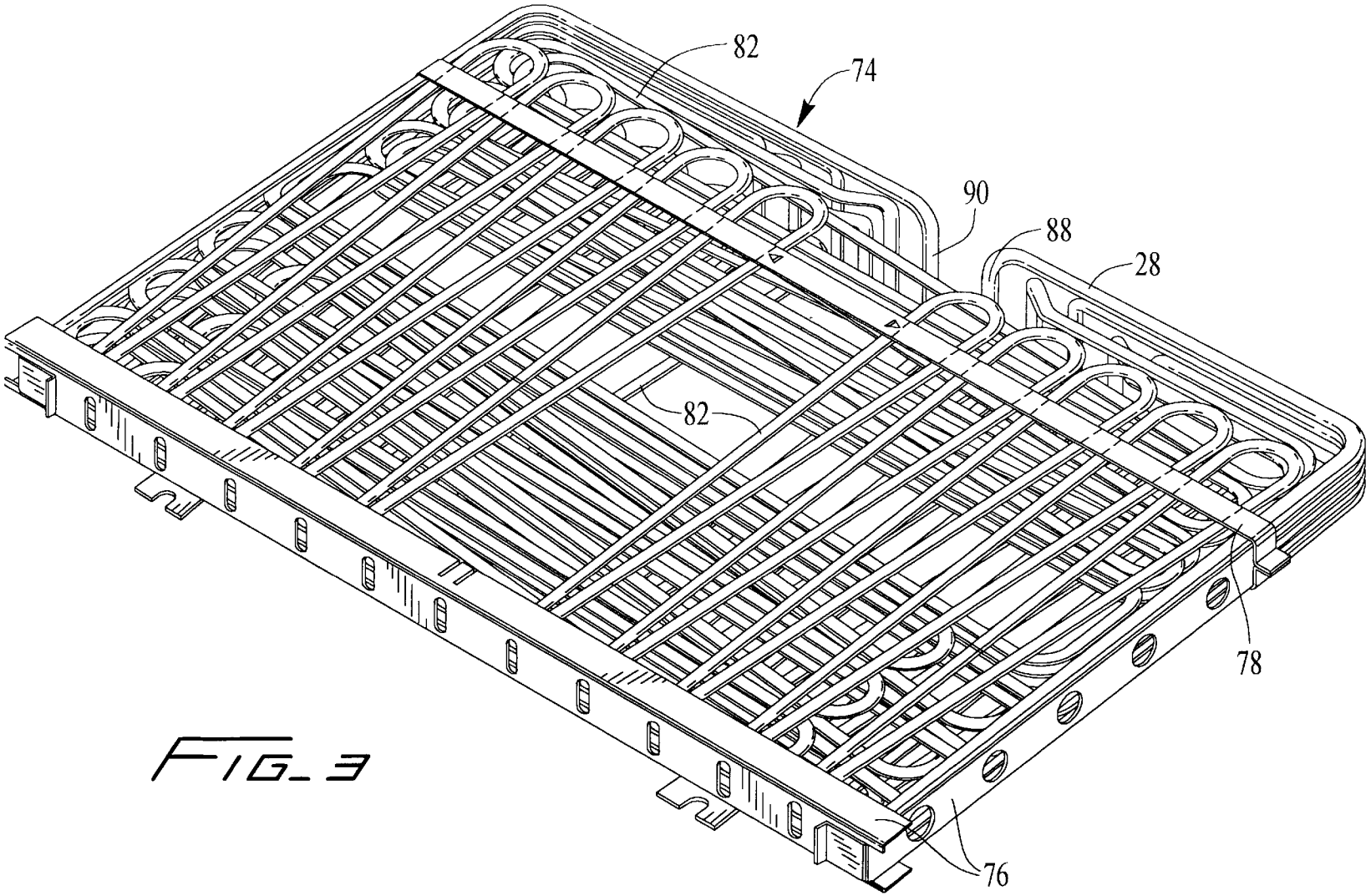
FIG. 3 is an isometric view of the coil and bracket assembly within the cold plate.

FIG. 3 illustrates the eight cooling circuits 28 within the cold plate 26. The cooling circuits 28 include a plurality of tubular coils 82 for carrying beverage liquids. The coils 82 wind around in a serpentine path. The coils 28 are stacked one on top of another, and are held together with frame members 76 and a strapping member 78. The frame members 76 are attached to the cooling circuits along one end thereof, and along at least one side of the cooling circuits. The strapping member 78 is attached around the entire eight cooling circuits 28. The top and bottom coils extend in a serpentine path substantially parallel to the strapping member 78 and one end frame member 76. The remaining coils between the top and bottom coils extend in a serpentine path substantially parallel to the strapping member 78 and one end frame member 76. Each of the cooling circuits 28 include an inlet 88 connectable to a source of fluid and an outlet 90 connectable to a dispensing valve.

While the invention has been described with reference to a preferred embodiment, those skilled in the art will appreciate that certain substitutions, alterations and omissions may be made without departing from the spirit of the invention. Accordingly, the foregoing description is meant to be exemplary only, and should not be deemed limiting on the scope of the invention set forth in the following claims.

We claim:

1. An improved ice chest and cold plate apparatus comprising:

an open container having a bottom, four sidewalls, and an open top;

a cold plate block attached to the bottom of the open container by a thermally conductive adhesive; and wherein the cold plate block includes a plurality of cooling circuits cast in aluminum.

2. The improved ice chest and cold plate apparatus of claim 1 further comprising an enclosure surrounding the open container and cold plate block.

3. The improved ice chest and cold plate apparatus of claim 2 wherein insulation is inserted between the enclosure, the container and the cold plate.

4. The improved ice chest and cold plate apparatus of claim 2 wherein mounting leg plates are attached to the bottom corners of the enclosure to facilitate easy field installation.

5. The improved ice chest and cold plate apparatus of claim 1 wherein the bottom of the open container includes a substantially smooth, flat outer surface.

6. The improved ice chest and cold plate apparatus of claim 5 wherein the cold plate block includes a substantially smooth, flat top surface.

7. The improved ice chest and cold plate apparatus of claim 6 wherein a continuous thin film of the thermally conductive adhesive is applied to the entire top surface of the cold plate block.

8. The improved ice chest and cold plate apparatus of claim 7 wherein the top surface of the cold plate is affixed to the outer surface of the bottom of the open container with the thermally conductive adhesive.

9. The improved ice chest and cold plate apparatus of claim 1 wherein the open container is an ice storage container made of stainless steel.

10. The improved ice chest and cold plate apparatus of claim 9 wherein the ice storage container is designed to contain ice.

11. The improved ice chest and cold plate apparatus of claim 10 wherein the ice is in contact with the stainless steel ice storage container.

12. The improved ice chest and cold plate apparatus of claim 11 wherein the stainless steel ice storage container is free of crevices or surfaces prone to bacteria growth.

13. The improved ice chest and cold plate apparatus of claim 10 wherein the ice is not in contact with the aluminum cold plate block.

14. The improved ice chest and cold plate apparatus of claim 1 wherein the thermally conductive adhesive is a casting resin designed for applications requiring a high degree of thermal conductivity.

15. A method of constructing an improved ice chest and cold plate apparatus, the ice chest including an open container having an open top, a bottom, and four sidewalls, the cold plate including a plurality of cooling coils cast in a thermally conductive material, the cooling coils coursing through the thermally conductive material in a serpentine pattern, the method comprising the steps of:

affixing the cold plate to the bottom of open container with a thermally conductive adhesive;

allowing the thermally conductive adhesive between the cold plate and the bottom of the open container to cure; and enclosing the open container and cold plate within an outer enclosure.

16. The method of claim 15 wherein the cold plate includes a substantially smooth, flat top surface.

17. The method of claim 16 wherein a continuous, thin film of the thermally conductive adhesive is applied to the top surface of the cold plate.

18. The method of claim 17 wherein the thin film of adhesive covers the entire top surface of the cold plate.

19. The method of claim 18 further comprising the step of bringing the adhesive applied top surface of the cold plate into contact with the outer surface of the bottom of the open container.

20. The method of claim 15 wherein the bottom of the open container includes a substantially smooth, flat outer surface.

21. The method of claim 20 wherein a continuous, thin film of the thermally conductive adhesive is applied to the outer surface of the bottom of the open container.

22. The method of claim 21 wherein the thin film of adhesive covers the entire outer surface of the bottom of the open container.

23. The method of claim 22 further comprising the step of bringing the top surface of the cold plate into contact with the adhesive applied outer surface of the bottom of the open container.

24. The method of claim 15 wherein the adhesive is a medium viscosity casting resin designed for applications requiring a high degree of thermal conductivity.

25. An improved beverage cooling apparatus comprising:

a cold plate heat exchanger block constructed of thermally conductive material such as aluminum and having a substantially smooth, flat top surface;

a plurality of cooling circuits embedded within the thermally conductive material, each cooling circuit comprising a tubular coil traversing through the interior of said thermally conductive block in a serpentine fashion, each coil having an inlet connectable to a source of fluid and an outlet connectable to a dispensing valve;

an ice storage container having an open top, a bottom, and four sidewalls, the bottom having a substantially smooth, flat outer surface; and wherein the cold plate heat exchanger is affixed to the bottom of the ice storage container with a thermally conductive adhesive.

26. The improved beverage cooling apparatus of claim 25 wherein a continuous thin film of the thermally conductive adhesive is applied to the outer surface of the bottom of the ice storage container.

27. The improved beverage cooling apparatus of claim 26 wherein the top surface of the cold plate heat exchanger block is affixed to the outer surface of the bottom of the ice storage container with the thermally conductive adhesive.

28. The improved beverage cooling apparatus of claim 25 wherein the thermally conductive adhesive is a medium viscosity casting resin designed for applications requiring a high degree of thermal conductivity.

29. The improved beverage cooling apparatus of claim 25 wherein the coils of the cooling circuits are held together with at least one frame member and at least one strapping member.

30. The improved beverage cooling apparatus of claim 25 wherein the frame members are attached to the cooling circuits along one end thereof, and along at least one side of the cooling circuits.

31. The improved beverage cooling apparatus of claim 25 wherein the strapping member is attached around the entire plurality of cooling circuits.

* * * * *